US006975563B2

(12) United States Patent
de Brito

(10) Patent No.: US 6,975,563 B2
(45) Date of Patent: Dec. 13, 2005

(54) TEST PACING WRISTWATCH WITH VIBRATION REMINDER

(76) Inventor: Dirk de Brito, 4358 Chevy Chase Dr., La Canada, CA (US) 91011

( * ) Notice: Subject to any disclaimer, the term of this patent is extended or adjusted under 35 U.S.C. 154(b) by 0 days.

(21) Appl. No.: 10/360,058

(22) Filed: Feb. 6, 2003

(65) Prior Publication Data

US 2004/0156271 A1 Aug. 12, 2004

(51) Int. Cl.[7] ..... G04F 8/00
(52) U.S. Cl. ..... 368/109; 368/69
(58) Field of Search ..... 368/107–113, 69, 368/230

(56) References Cited

U.S. PATENT DOCUMENTS 4,236,238 A * 11/1980 Komiyama et al. ..... 368/71
4,337,529 A * 6/1982 Morokawa ..... 377/20
4,451,158 A 5/1984 Selwyn et al.
4,989,188 A 1/1991 Thinesen
5,050,141 A 9/1991 Thinesen
5,140,564 A 8/1992 Rich
5,257,244 A 10/1993 Thinsen
5,282,181 A 1/1994 Entner et al.
5,301,154 A 4/1994 Suga
5,642,334 A 6/1997 Liberman
5,796,681 A 8/1998 Aronzo
5,861,797 A * 1/1999 Becker ..... 340/309.3
5,878,004 A 3/1999 Miyauchi et al.
5,929,747 A * 7/1999 Rosenblatt et al. ..... 340/309.7
2002/0114223 A1 * 8/2002 Perlman et al. ..... 368/109

* cited by examiner

*Primary Examiner*—Kamand Cuneo
*Assistant Examiner*—Thanh S. Phan

(57) ABSTRACT

A multimode electronic timepiece for assisting a person to take a multiple question timed examination. The number of questions and test time are entered into the timepiece along with selected alert points. A test timer mode then displays time remaining in the examination along with the corresponding question number, and a silent vibrating alarm alerts the person at the preselected alert points, and displays appropriate informative and encouraging messages.

9 Claims, 8 Drawing Sheets

MEMORY
20
18
S1
S2
S3
S4
MICROCOMPUTER
VIBRATOR
24
QUARTZ TIMEBASE
26
DECODER/DRIVER
22
14
12
16
15
SET
TEST
TIMER
AM
PM

TEST PACING WRISTWATCH WITH VIBRATION REMINDER

BACKGROUND OF THE INVENTION

This invention pertains generally to the field of timing and pacing devices, and more specifically to a device for pacing an examinee through an examination, so that he or she (hereinafter "it") is silently and unobtrusively reminded to monitor its progress throughout a standardized multiple choice test so as to complete the test on time and in a calm, consistent manner.

Education in developed countries has increasingly relied upon standardized testing as a way of defining and quantifying educational potential and achievement. Multiple choice testing has become the method of choice, providing a cost effective and efficient means to assess knowledge. Lives are molded by how students perform on tests such as the SAT, GRE and a rich variety of vocational exams, from civil service to professional exams such as legal or medical boards. Performance on standardized tests determines an individual's ability and opportunity to fulfill its dreams and provide for its families. Unfortunately, varying skill at test taking mechanics presents a confounder to assessing student ability.

Students in all walks of life have massive difficulty in pacing themselves while taking a test. Often they rush themselves, incorrectly overestimating how fast they should progress through the questions, making mistakes they would not have made if they had paced themselves better. Typically, they end the test with time remaining and then struggle to make changes which are generally unadvisable. Worse, other students underestimate their speed, being caught up in beginning questions only to find time has run out and they cannot finish the exam. This invention effectively stops these catastrophes.

In addition to the most common standardized tests and users, several specific situations offer particularly difficult testing challenges. This invention levels the field for persons who have the required knowledge and intelligence yet may have learning disabilities. Learning challenges such as Attention Deficit Disorder can make pacing particularly important, since consistent effort is especially difficult. For the deaf test taker, the device becomes especially useful, since the vibratory reminder becomes the best form of communication with the user. Advanced users, such as those facing a series of long essays over several hours in law school, for example, may easily lose track of the appropriate pace despite the relatively small number of questions they face. For this application, it is particularly practical to be able to, by pressing a single button, see how much time remains within a specific question's time interval in order to be on pace.

Various timing and countdown devices are well established in the prior art. There exist timing devices capable of signaling progressive elapses of countdown periods, such as U.S. Pat. No. 4,451,158 (Selwyn et al). This discloses a countdown timer utilizing a voice synthesizer to announce the elapsed countdown. There exists dual function wristwatch and time calculating devices, such as U.S. Pat. No. 5,301,154 (Suga), which discloses a device which works as both a pulse frequency calculator and memory device for runners while running a given distance as well as a wristwatch. However, there is minimal prior art that is suitable as well as effective for use in the preeminent educational proving ground of our time, the standardized multiple choice test. Since most standardized tests have a plurality of questions of similar average difficulty and a predetermined amount of time allotted in which to answer them, successful examinees must pace themselves in order to appropriately spread their efforts during the test.

Two crucial aspects govern the success of a pacing device for standardized tests. Firstly and most obviously, the device must be permitted by the rules governing the taking of most standardized tests. Most standardized tests specifically prohibit the bringing of all personal belongings to a test, with the exception of identification, glasses, handicapped assistance devices and a wristwatch. Most standardized tests specifically prohibit the bringing of any calculating devices of any kind. Most standardized tests specifically prohibit the bringing of any device with noise making ability or audible alarms which are not shut off, so that other test takers sitting nearby are not disturbed.

The second critical aspect is that a test pacing device not just have the relatively simple computing ability to divide the time, but also the functional ability to prompt the user to use the device throughout the test. This is essential because examinations are tremendously stressful, for both children as well as adults. It is entirely impractical to rely on the already maximally stressed user to remember yet more things, namely to appropriately schedule checking their pacer watch. The users who need the device the most, whether they simply have trouble developing a consistent rhythm on a test or who have more significant difficulties such as Attention Deficit Disorder, are precisely the users who can least be relied upon to consistently check their pacer without prompting.

Pacing examinees during multiple choice tests has been addressed in the prior art by a number of United States Patents, such as U.S. Pat. No. 5,140,564 (Rich, Aug. 18, 1992), U.S. Pat. No. 5,642,334 (Liberman, Jun. 24, 1997) and U.S. Pat. No. 5,796,681 (Aronzo, Aug. 18, 1998). However, these solutions entirely fail both of these two critical aspects that would allow for practical use during a standardized multiple choice examination.

U.S. Pat. No. 5,140,564 was granted to Rich. It described a square box to be used during a test for pacing. However, as an electronic item of personal property that is not a wristwatch, it might be prohibited at most standardized multiple choice tests. Even if test proctors were inclined to bend the rules of an exam, their own common sense would tell them that advances in electronics and memory might allow a box with a plurality of switches and a display to be programmed with an enormous amount of information which might be useful and therefore might represent cheating on an exam.

Similarly, the dual function of U.S. Pat. No. 5,642,334 (Liberman) is that of a pacing device and mechanical pencil. Its function necessitates an alphanumeric keyboard and display, allowing the possibility of enormous calculation and innformation storage capabilities. U.S. Pat. No. 5,796,681 (Aronzo) is a freestanding device that displays the examinee's question answering time, providing large statistical displays in most embodiments, large numbers of buttons in other embodiments, and in no embodiment having dual function as a wristwatch.

Of equal importance, the second critical issue of reminding the user to use the pacer during the test has not practically been solved until the device of the present invention. U.S. Ser. No. 5,140,564 (Rich) provided users no reminder or alert for the user to remember, despite the stress of the exam, to use the device appropriately while taking the test. Users might either forget about the device completely, or until it was too late to repair their incorrect pace, or worse, might waste the precious time the device is supposed to help manage by continually checking the display.

U.S. Pat. No. 5,642,334 (Liberman) has flashing warning lights which, since light is free to travel about in an examination room, would be disturbing to adjacent test takers. Its efficiency at alerting the user would be similar to its efficiency at annoying nearby examinees. This might cause the device's confiscation, resulting in tremendous stress for the user, or worse, might cause the user to be disqualified on the grounds that personal electronic devices which are not wristwatches had been brought into the test. Similarly, U.S. Pat. No. 5,796,681 (Aronzo) describes the way to " . . . display a shortage of time is by flashing or changing color," or with an audible signal. This likewise might not be allowed at a standardized exam.

U.S. Pat. No. 5,282,181 (Entner) describes a wearable alarm watch enabling a deaf person to enjoy the benefits of wearing an alarm watch. The device has no ability to input information useful in a test nor does it have any pacing ability of any kind. U.S. Pat. No. 5,878,004 (Miyauchi) further describes a wristwatch vibration alarm with a flat stator type bipolar stepping motor with a rotor of high durability which requires low power consumption. It does not describe any test taking usefulness.

Multi-mode electronic wrist watches are well-known in the art to perform functions in addition to basic timekeeping and date keeping, such as displaying alternate time zones, beeping alarm watches, and pace-setting for runners. These alternate capabilities, or modes, are selected by actuating manual switches on the watch in a prescribed sequence and observing the results on the watch display. Examples of multi-mode electronic wristwatches, all in the name of Tom Thinesen, are seen in U.S. Pat. No. 4,989,188 (temporarily viewing a mode other than the current mode), U.S. Pat. No. 5,050,141 (pacing a runner with periodic beeping sounds) and U.S. Pat. No. 5,257,244 (displaying instructional messages for mode navigation).

Accordingly, one object of the present invention is to provide a dual function wristwatch and test pacer that can be used to pace the examinee's progress and provide silent reminder alert points in standardized multiple choice tests or other types of timed examinations.

Another object of the invention is to provide a test pacing device with a vibration function that critically enhances the practical usefulness of the device by providing alert point reminders which in no way disturb others, yet are difficult for the user to accidentally ignore.

Another object of the invention is to provide an improved multi-mode wristwatch, particularly adapted as a test timing pacer and periodic reminder, but with no function, which might cause it to be barred from the examination room.

SUMMARY OF THE INVENTION

Briefly stated, the invention comprises an improvement in a multi-mode electronic timepiece especially adapted to assist a user to take a multiple question timed examination, the timepiece having an electrooptic display, a memory, a vibrator alarm device, several manually actuated actuators and a programmable integrated circuit programmed to keep time and to provide several timepiece operating modes including a test timer mode, the integrated circuit being further programmed to permit an operator to switch between modes in response to actuation of a selected actuator; the integrated circuit being further programmed to display information relating to the examination in response to actuation of a selected actuator; the integrated circuit being further programmed to display, to increment, to decrement, and to store displayed information in memory in response to actuation of a selected actuator, to perform calculations thereon and to display information and results of calculations on the display; the integrated circuit being further programmed to provide vibrations produced by said vibrator alarm device in response to information stored in memory.

The improvement of the present invention includes a test timer setting mode adapted to enable a user to select and store in memory 1) a selected examination time period, 2) a selected number of examination questions, and 3) a selected number of alert points, and a test timer mode adapted 1) to display time remaining in the examination and the question number corresponding to time remaining, and 2) to actuate said vibrator alarm device at each occurrence of an alert point. In a further improvement, a pre-selected message is displayed at pre-selected alert points after actuating the vibrator alarm device.

BRIEF DESCRIPTION OF THE DRAWINGS

This invention, both as to organization and method of practice, together with further objects and advantages thereof, will best be understood by reference to the following description taken in connection with the accompanying drawings, in which.

DESCRIPTION OF THE PREFERRED EMBODIMENTS

Figure 1:
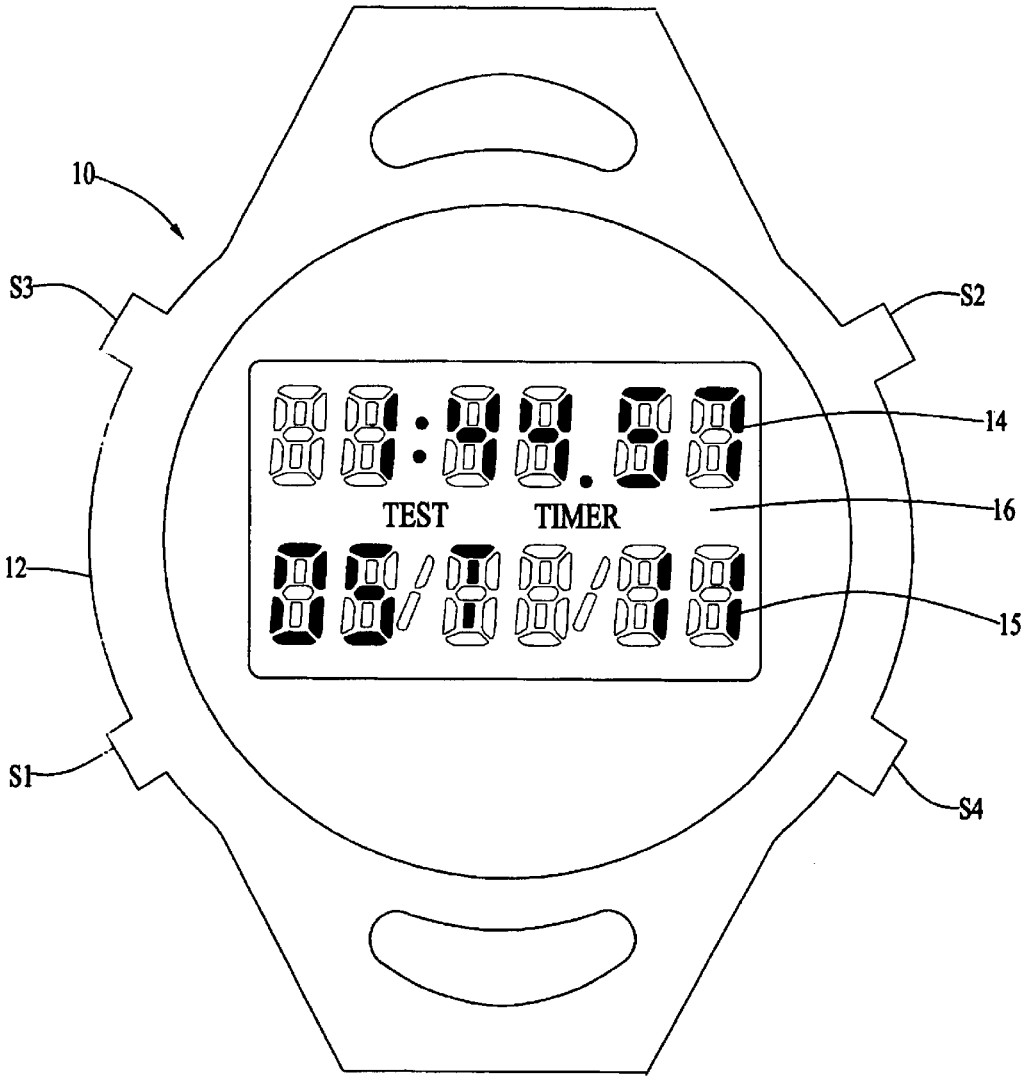
FIG. 1 is a simplified plan view of the test timer watch, shown in test timer run mode.

Referring now to FIG. 1 of the drawing, an exam pacing watch 10 is housed in a plastic case 12 of water and shock resistant design and a standard adjustable wrist strap (not shown). Stamped into the back of the pacing device are words similar to "This watch is a pacing device, and has no memory recall ability, calculation data display or noise functions." A number of side mounted manually activated switches preferably implemented as push button switches S1, S2, S3 and S4, each in turn labeled ADVANCE, SET, MODE/SELECT and LIGHT are arranged to close spring metal contacts internally in a manner well-known in the art.

An electrooptical display 12 is disposed in the top of the case, typically a liquid crystal display, and is divided into a first upper set of actuatable segments 14 and a second lower set of actuatable segments 15 for displaying alphanumerical patterns.

Time of Day Mode

FIG. 1 depicts the watch in normal time of day mode. The upper segments 14 display the time in hours, minutes and seconds in a digital fashion. The lower segments display the abbreviation for the day of the week as well as the date, with the digital representation of the day of the month and the month separated by a backslash symbol. The display may also include a number of connected letters to be actuated to display an entire word representing the month, and day of week.

Figure 2:
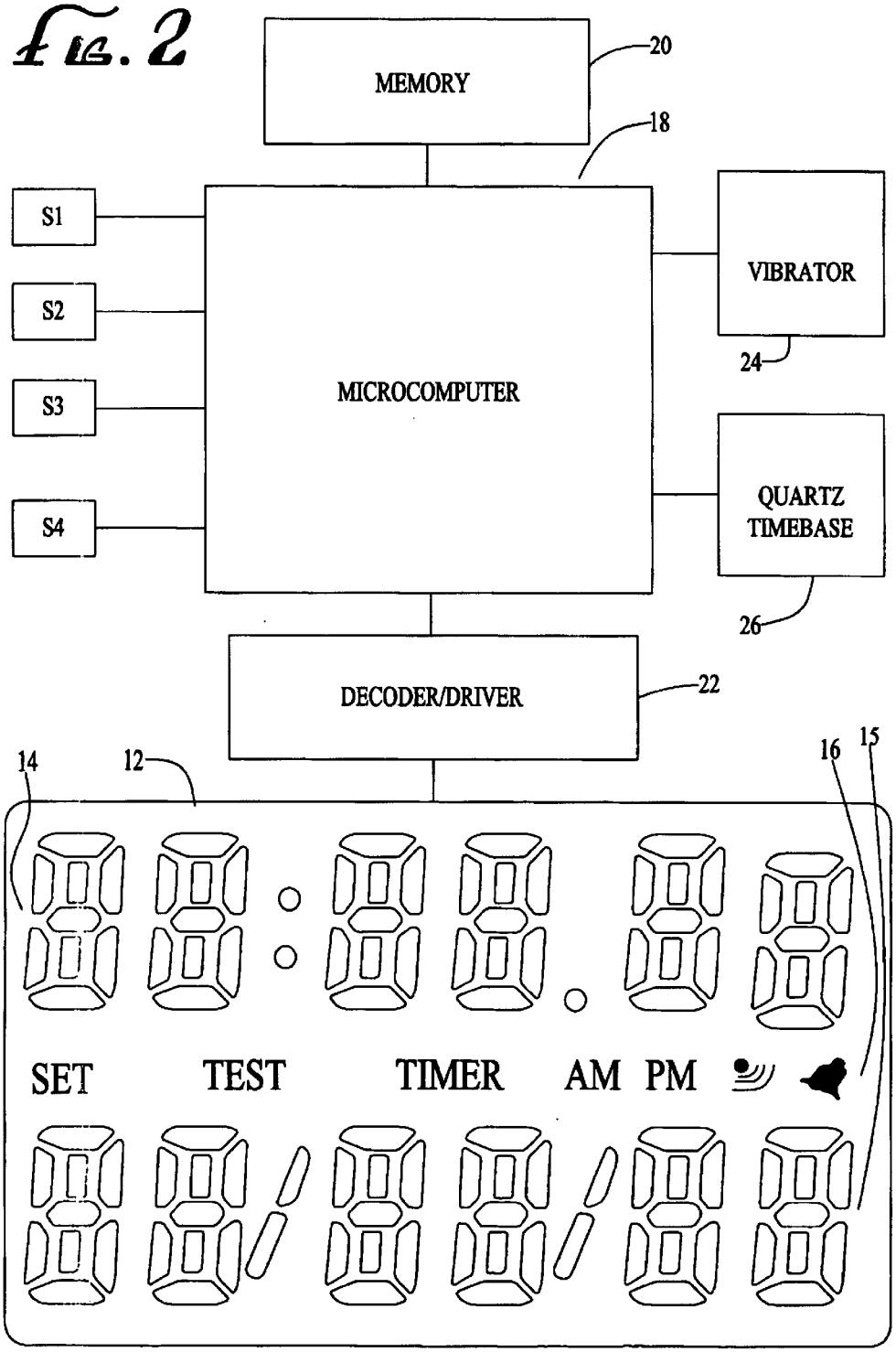
FIG. 2 is a simplified block diagram of the test timer watch of FIG. 1, and the associated display.

Referring now to FIG. 2, of the drawing the diagram illustrates an integrated circuit which is a commercially available mask-programmable microcomputer chip, hereinafter designated microcomputer 18, having internal microprocessor, RAM and ROM memory, input and output circuits, LCD display drive circuits and programmed instruction sets. Many similar microcomputers are readily available, but a suitable microcomputer for this application is Part Number SPL09A1 by SUNPLUS Technology. Any such microcomputers may be programmed using masks during the final stages of the production process to complete standard instructions in the manner of known computers. Depending on the type of microcomputer selected, a separate ROM memory 20, and a separate decoder/driver 22 may be included as separate integrated circuit chips.

Also shown in FIG. 2 is vibrator 24, driven by a vibrating motor, whose activation creates a vibration alert felt by the wearer of the device of the preferred embodiment. Many similar small size vibration generating motors are readily available, but a suitable vibrator for this application is Part Number SE-54E by Shicoh Engineering.

Also shown in FIG. 2 are the schematic circuit representations of the manually actuated switches labeled S1, S2, S3 and S4. Enclosed in the watchcase with the integrated circuit and the electooptical display 12 are a number of additional circuit elements which are well known to those skilled in the art and normally understood to be part of the operational parts of a digital wristwatch circuit. These include a quartz crystal 26 serving as a timebase in the timer clock. An energy source is provided in the form of a button type energy cell (not shown) in the watch module. Several fixed value capacitors (not shown) are combined with other circuit elements in the microcomputer to boost the output voltage to drive the electrooptical display through the display decoder/driver 22, the last of which has several parallel leads which connect to the various actuatable segments of the electrooptical display 12. These display lines are numbered 14, 15 and 16 as shown in FIG. 1.

Figure 3:
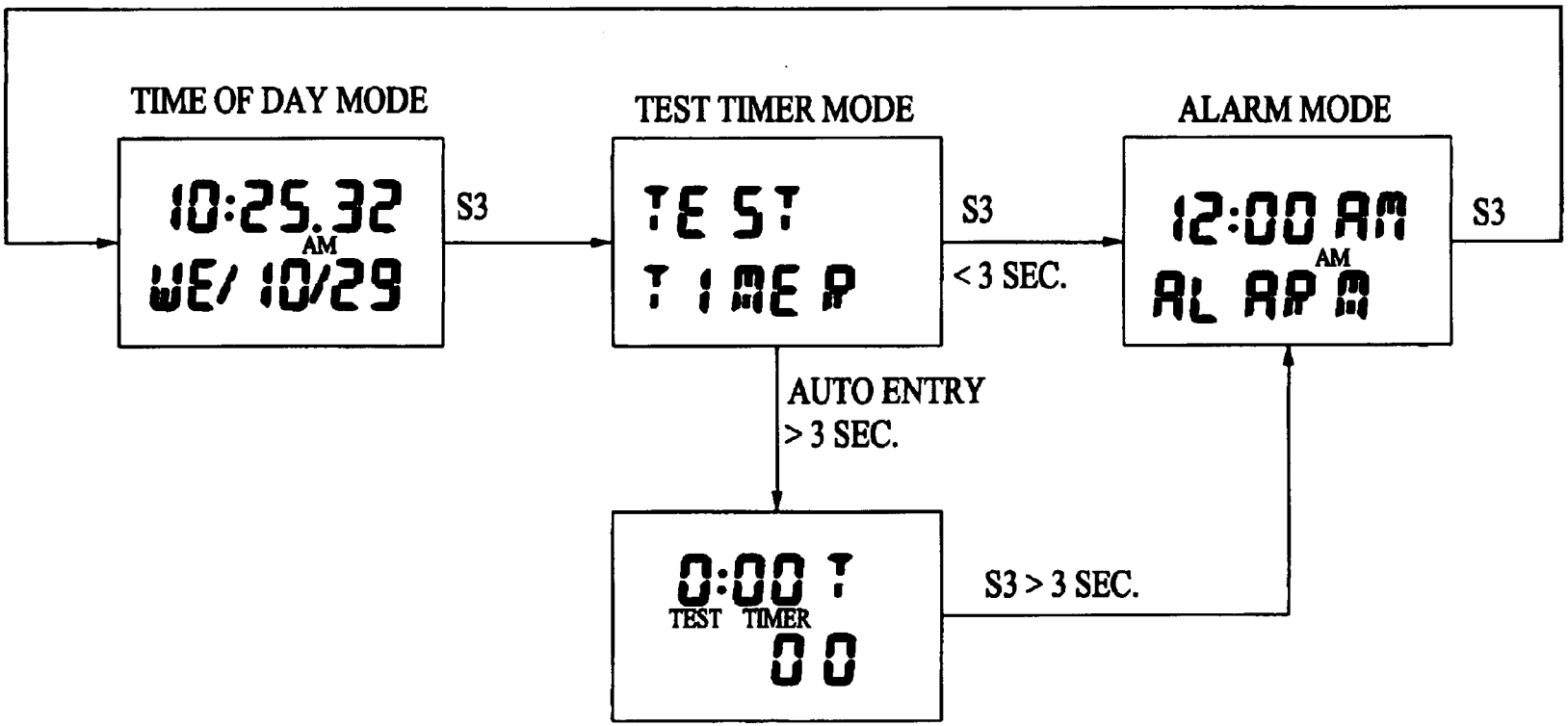
FIG. 3 is a simplified diagram of operation sequence, indicating basic operation modes of the test timer watch.

Briefly, the different functional modes available in the watch are as follows:

Test Timer Mode (FIG. 3)

Test timer mode is entered by pressing S3 (Mode/Select) from the normal time of day mode. Entry into test timer mode is signaled by the words "test mode" displayed in groups of segments forming complete words or symbols in display line 16 between lines 14 and 15. Pressing S2 (Set) or simply waiting approximately three seconds enters Test Tim r Set mode. Pressing S4 (Light) will, as in most cases, throughout this description, illuminate the electroluminescent display.

Figure 4:
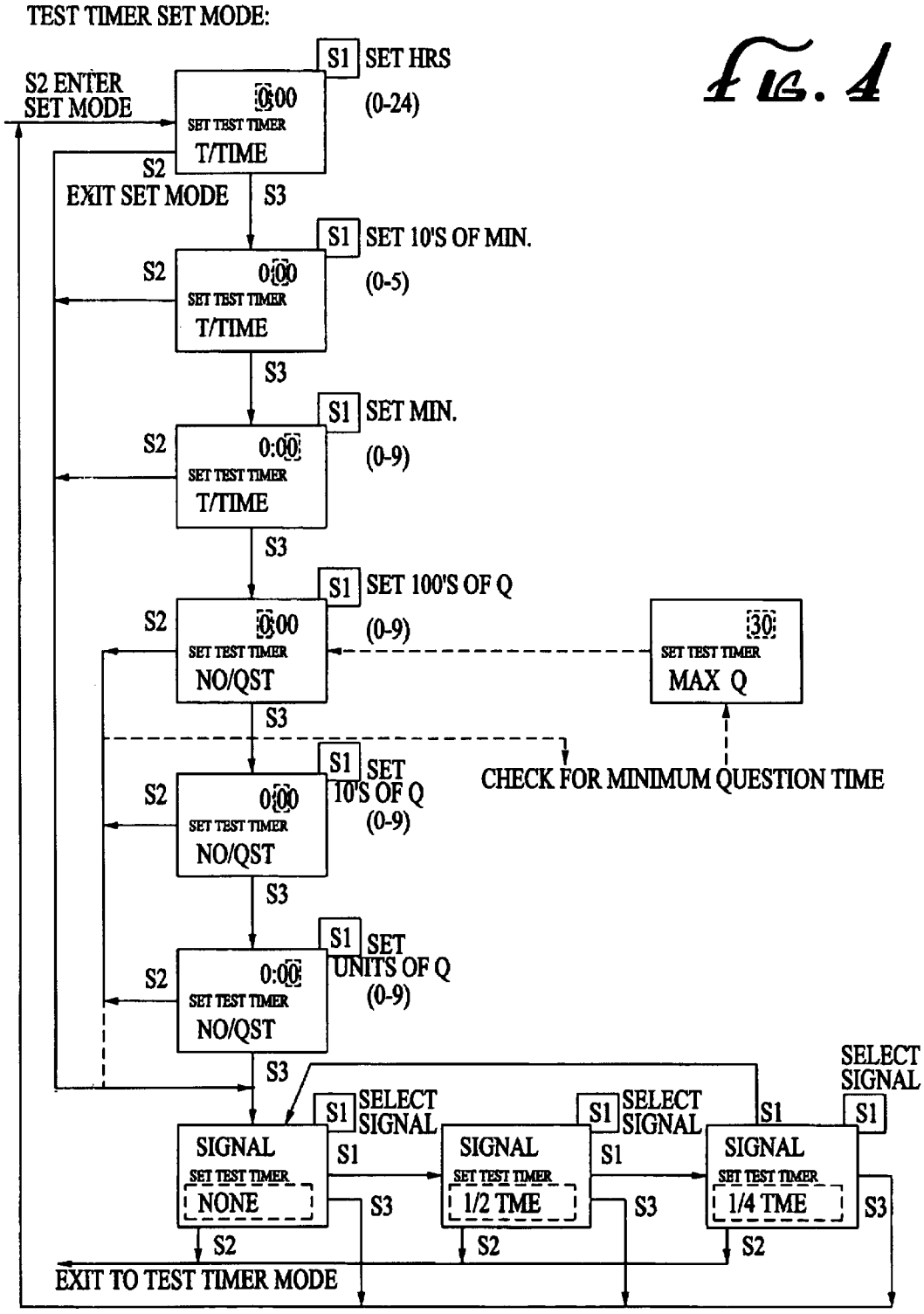
FIG. 4 is a detailed block diagram illustrating states of operation while in the test timer set mode.

Test Timer Set Mode (FIG. 4)

This mode is used to set the exam parameters prior to beginning an exam. Initially the display shows (FIG. 6A) a representation of zero hours and zero minutes on the upper line followed by a T/TIME on the lower line, representing the test length or examination time period which must be inputted. A flag display in the central line reads "set test timer." Pressing S3 (Mode/Select) selects digits which first cause the left hand (hours) analog digit, then the second (tens of minutes) and then the third (minutes) analog digits to pulse on and off, indicating they are ready to be set. Setting each digit is accomplished by pressing S1 (Advance) which advances the analog numerical display of this digit by one with each pressing, in the customary fashion. In each case, pressing S2 (Set) sets this digit and causes the next digit in turn from left to right to pulse indicating it also may be set in the same fashion.

After the examination time period has been thus input, the display shifts as shown in FIG. 4 to allow the user to input the number of examination questions. The display shows (FIG. 6B) a representation of "000" questions on the upper line and the message NO/QST on the lower line. The zero representing "hundreds" of questions pulses on and off, representing the opportunity to set the number of questions on the exam. This number is likewise input by pressing S1 (Advance) until the desired number is reached and then pressing S2 (Set) to set it. Holding S1 (Advance) for longer than approximately two seconds allows the numbers to scroll rapidly in the customary fashion, stopping when S1 (Advance) is released and allowing for single presses of the button to further set the number of questions until the desired number is reached and S2 (Set) is pressed. In like manner the "tens" and "units" of questions are input as illustrated in FIG. 4.

The next parameters to be input are the time intervals to set the alert points at which a vibrating alarm will prompt the examinee to check the pace with which it is completing the exam. Thus, when the vibration occurs, the examinee will know to look at the device and compare the question number indicated on the lower display line with the question number that it is currently considering. By doing so, the examinee knows that if it has at least completed this question number it is on pace to complete the exam in the time allotted.

Figure 7A:
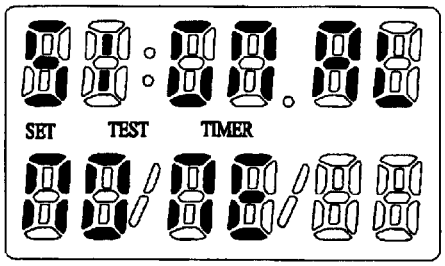
FIGS. 7A, 7B and 7C are wristwatch diaplays illustrating a typical sequence of display appearances for setting vibration reminders to be displayed during the exam.

To commence the alert point setting sequence as shown in FIG. 4, the word "signal" is shown on the upper display line. The words "set timer mode" is displayed on the central flag line. The lower display line initially displays the word "none," (FIG. 7A), which pulses indicating that it may be set by sequentially pressing S1 (Advance).

Pressing S2 (Set) would provide the examinee with no additional vibration alerts other than the preset default vibration which occurs as a final alert point when ten minutes are remaining in the test. Note that if a test length of less than ten minutes is input, no vibration alert will occur.

Figure 7B:
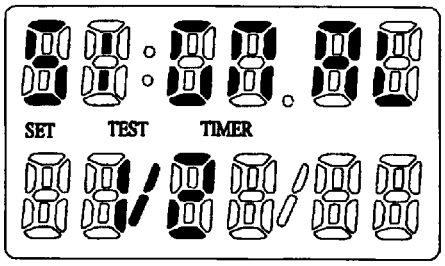

The user may select a number of alert points at which the watch will vibrate to alert the examinee to check its progress. If instead of pressing S2 (Set) the user presses S1 (Advance) once, this changes the lower display line to indicate the fraction ½, represented by a 1, a backslash and a 2, followed by TME, representing the word "time" (FIG. 7B). Pressing S2 (Set) would provide the examinee with an additional vibration alert point (other than the preset default vibration with ten minutes remaining in the test) at the half way point of the exam. This input is used to calculate and establish an alert point which falls at the half-way point in the examination time period. The time to reach this alert point is counted up in the same manner as are the number of exam questions.

If instead of pressing S2 (Set), the user again presses S1 (Advance), the display line 15 changes to the fraction ¼, represented by a 1, a backslash and a 4. Pressing S2 (Set) provides the examinee with a vibration alert point at the completion of each quarter of the exam, in addition to the default alert which occurs when there are ten minutes remaining in the test.

Figure 7C:
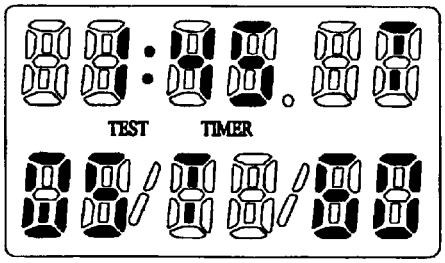

In any of these cases in test timer signal mode, pressing S2 (Set) initiates the device to display the input test time and input number of questions. As example, this application will use a test length of one hour and forty five minutes, having 60 questions (FIG. 7C). Pressing S1 (Advance) begins Test Timer Run Mode and is pressed by the examinee at the commencement of the test.

Figure 5:
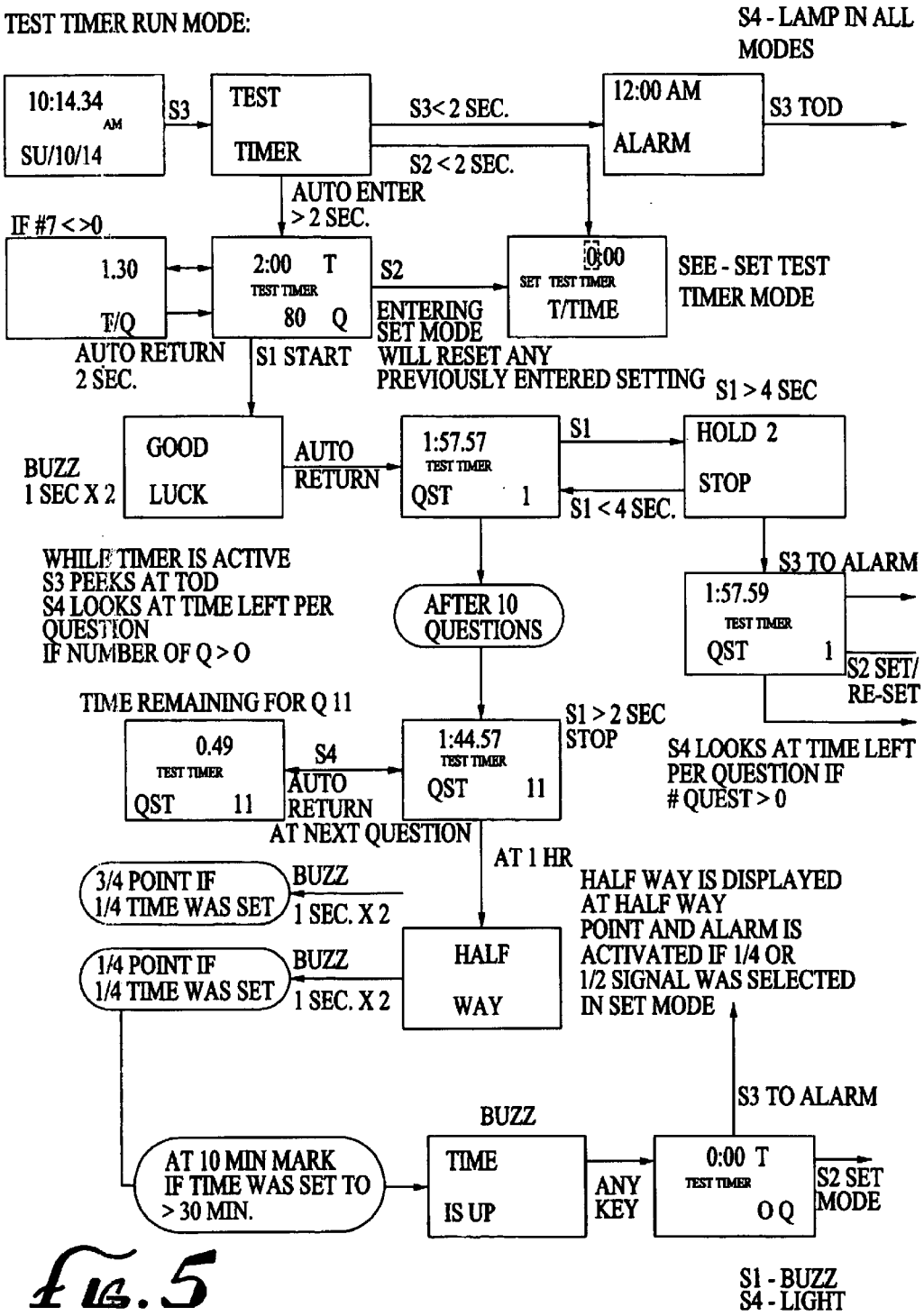
FIG. 5 is a detailed block diagram illustrating states of operation while in the test timer run mode.

Test Timer Run Mode (FIG. 5)

Figure 8A:
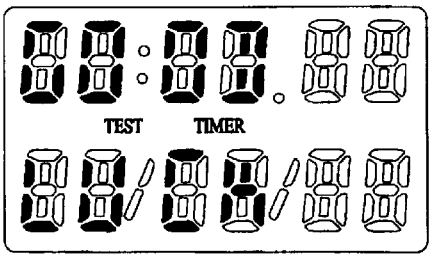
FIGS. 8A, 8B, 8C, 8D, 8E and 8F are wristwatch displays illustrating typical display appearances, including relaxation messages, to be displayed during the actual taking of the test.
Figure 8B:
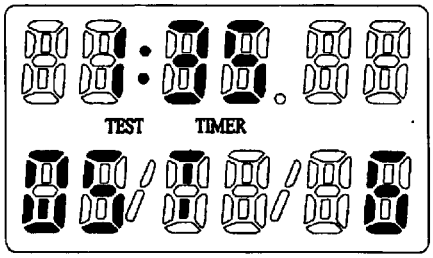

This mode is used during the test. After S1 (Advance) is pressed by the examinee when it is told to begin the test, the display reads "Good Luck." (FIG. 8A) for approximately three seconds, confirming that Test Timer Run Mode is now in operation. From this point on during the test, the successively decrementing time remaining for the examination is simultaneously displayed on upper display line 14 with the successively incrementing test question number shown on lower display line 15. This represents the question number that should have been reached by that time in order to complete the test in the time allotted. The central flag line 16 now reads "Test Timer" as it does at all times during test timer run mode with the exception when text massages are displayed (such as "Good Luck," described above). To continue with the example above, ten minutes after the test had begun (FIG. 7C), the display shows one hour thirty five minutes remaining in the test and question number 6 (FIG. 8B). Display line 14 shows the hours and minutes separated by a colon. The flag display line 16 continuously shows the words "Test Timer," Display line 15 shows the letters "QST," representing the word "question" followed by the number six indicating that the test taker should be working on question number six or higher. By doing so, the test taker will know that if he or she continues at that same pace, they will complete the examination in the time allotted.

Figure 8C:
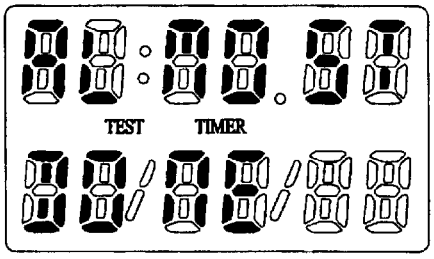

If the test taker has selected "none" in the Test Timer Signal mode, the only vibration alert that he or she will receive will be the default one which occurs at ten minutes prior to the conclusion of the test. After this alert, as with all vibration alerts during Test Timer Run mode in the preferred embodiment, a relaxing or encouraging message ("Almost Done") will be displayed for approximately three seconds (FIG. 8C).

Figure 8D:
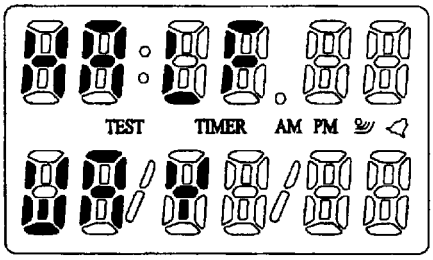
Figure 8E:
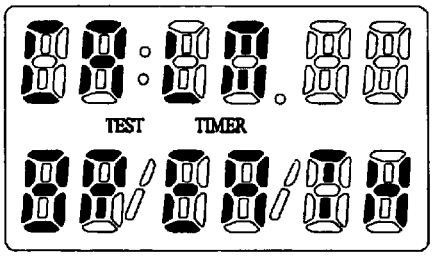
Figure 8F:
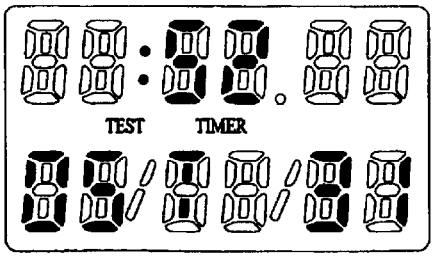

If the test taker has selected "½" in the Test Timer Signal mode, in addition to the default vibration alert at ten minutes remaining, the test taker will receive an additional vibration alert when ½ of the exam time has elapsed. Thus, in the example above in the preferred embodiment, 52 minutes and 30 seconds after initiating the exam whose duration has been input as 1 hour 45 minutes (FIG. 7C), a vibration alert would occur. The display would show the message "Half Way" (FIG. 8D) for approximately three seconds followed by the calming message "Calm Breath" (FIG. 8E) for approximately three seconds, with the screen reverting back to the typical Test Timer Run mode display with time remaining shown on display line 14 and the question that should have been reached on display line 15 (FIG. 8F).

Figure 9A:
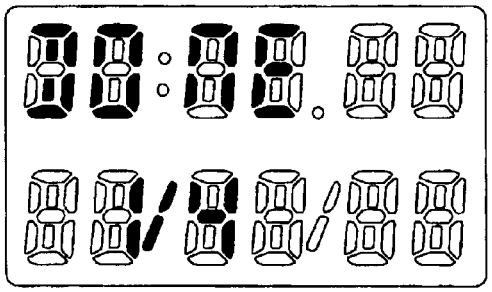
FIGS. 9A, 9B, 9C, 9D and 9E are wristwatch displays illustrating typical displays during the actual taking of the test if the examinee elects to have vibration alert points and messages displayed after each quarter of the test.
Figure 9B:
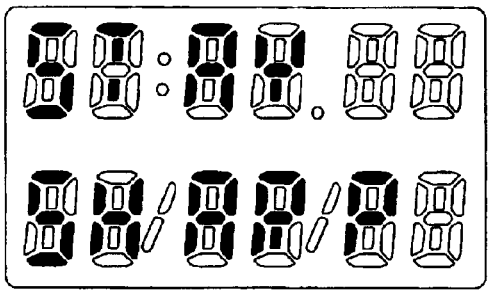
Figure 9C:
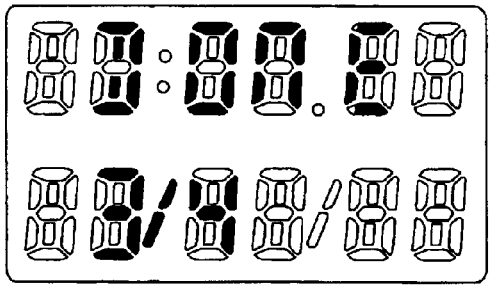
Figure 9D:
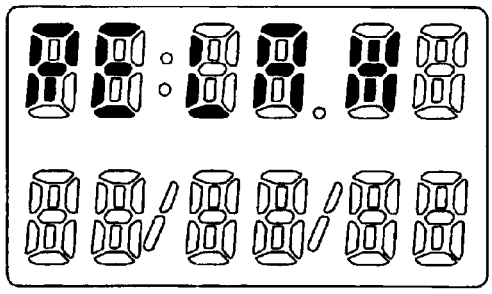

Similarly, if the test taker has selected "¼" in the Test Timer Signal mode, the test taker will receive two additional vibration alerts. Thus, in total, they will receive vibration alerts at times-corresponding to: 1) the time when ¼ of the exam allotted time has elapsed, 2) the time when ½ of the exam allotted times has elapsed, 3) the time when ¾ of the exam allotted time has elapsed and 4) the default vibration alert at ten minutes remaining in the exam. In our example, these would occur in sequence after: 1) 26¼ minutes, 2) 52½ minutes, 3) 78¾ minutes, and 4) 1 hour and 35 minutes. The display sequences occurring at the half way point in the exam as well as with ten minutes remaining in the exam would occur identically to the last example, as if the test taker had selected "½" in the Test Timer Signal mode. The two additional alerts would occur with similar display sequences ending in new messages. When ¼ of the exam time allotted has elapsed, the displayed message sequence would be "Done ¼" for approximately three seconds followed by "Stay Sharp" for approximately three seconds (FIGS. 9A and 9B). When ¾ of the exam time allotted has elapsed, the displayed messages sequence would be "Done ¾" for approximately three seconds followed by "Relax" for approximately three seconds (FIGS. 9C and 9D).

Figure 6A:
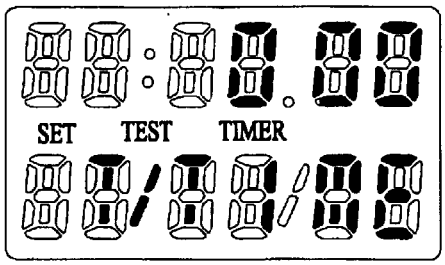
FIGS. 6A and 6B are wristwatch displays illustrating a typical sequence of display appearances during the test timer set mode, just prior to beginning a standardized test.
Figure 6B:
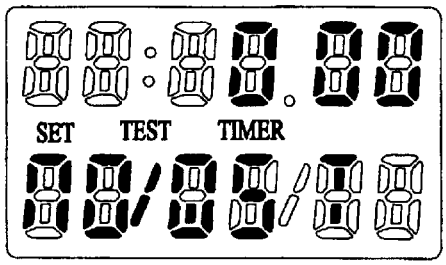
Figure 9E:
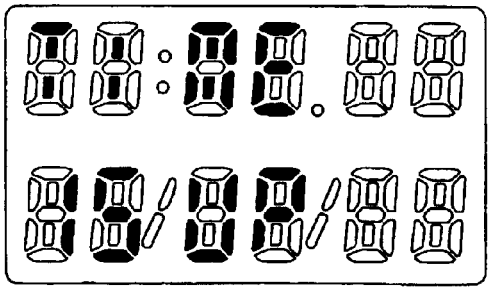

At the finish of the input exam time, when the time remaining reaches zero, the display shows "Time is Up" (FIG. 9E) for approximately three seconds followed by the words "Good Job" for approximately three seconds. After this, the display reverts to the initial Test Timer Set mode display, (FIG. 6A). This can be used to set new exam time parameters for the next test. Pressing S3 (Mode) will take the user back to normal time of day mode, as described above.

Alarm Mode and Time of Day Mode

The multimode electronic watch has the usual functions found in such a watch, such as a time-of-day mode and an alarm mode, as are well known in the prior art. Alarm mode is entered by successively pressing the mode/select switch S3 from the normal time of day mode as shown in FIG. 3. If other than a vibration alarm is desired, this is selected and indicated by an alarm symbol on the display flag line 16 in the customary fashion. The operation of electronic time pieces in this type of "alarm set mode" is well known as is "time of day set" mode and is not discussed in any detail in this application.

Other embodiments of the present invention would have additional choices for vibration alerts and messages. For example, rather than selecting the number of alert points and calculating the time intervals between alert points, the user would be able to set a time increment representing the time interval between successive vibration alerts and messages, such as every ten minutes, every five minutes or whatever number of minutes was selected until the completion of the exam. Another embodiment might create a pool of potential messages of encouragement and relaxation, which would be selected from at random by the device and displayed at whatever intervals are selected for vibration alert during the exam. Thus, in addition to the encouraging messages described above, additional messages might include: "Keep Calm," "Stay Smooth," "Shake Out," "Keep Focus," "You're Right," "Stay Cool," "Move Neck," "Chill Out," and "Stay Strong." Another embodiment might have the ability for the examinee to select these messages to appear without an associated vibration alert, providing a calming influence without the vibration prompt. Other embodiments within the scope of the invention are pocket watch versions, necklace versions, as well as pager or keychain versions. All of these are carried on the person and capable of causing the examinee to feel the vibrator alarm device.

While there has been described what is considered to be the preferred embodiment of the invention, other modifications will occur to those skilled in the art, and it is desired to secure in the appended claims all such modifications as fall within the true spirit, and the scope of the invention.

What is claimed is:

1. Improvement in a multi-mode electronic timepiece, said timepiece having an electrooptic display, a memory, a vibrator alarm device, a plurality of manually actuated actuators and a programmable integrated circuit programmed to keep time and to provide a plurality of timepiece operating modes, said integrated circuit being further programmed to permit an operator to switch between modes in response to actuation of a selected actuator; said integrated circuit being further programmed to display information in response to actuation of a selected actuator; said integrated circuit being further programmed to display, to increment, to decrement, and to store displayed information in memory in response to actuation of a selected actuator, to perform calculations thereon and to display said information and results of said calculations on said display; said integrated circuit being further programmed to provide vibrations produced by said vibrator alarm device in response to information stored in memory, wherein said improvement comprises;

a multi-mode electronic timepiece especially adapted to assist a user to take a multiple question timed examination, said multi-mode electronic timepiece comprising:

a test timer setting mode adapted to enable a user to select and store in memory 1) a selected examination time period, 2) a selected number of examination questions, and 3) a selected number of alert points; and a test tinier mode being adapted 1) to display time remaining in the examination and the question number corresponding to time remaining, and 2) to actuate said vibrator alarm device at each occurrence of an alert point;

said multi-mode electronic timepiece in said timer mode being operable to calculate the time remaining for each displayed question number, the time remaining for said displayed question number being selectively displayed responsive to actuation of a selected actuator.

2. The improvement according to claim 1, wherein said test timer mode causes said display means to display a pre-selected message on the electrooptic display at pre-selected alert points after actuating said vibrator alarm device.

3. Improvement in a multi-mode electronic timepiece, said timepiece having an electrooptic display, a memory, a vibrator alarm device, a plurality of manually actuated actuators and a programmable integrated circuit programmed to keep time and to provide a plurality of timepiece operating modes including a test timer mode, said integrated circuit being further programmed to permit an operator to switch between modes in response to actuation of a selected actuator; said integrated circuit being further programmed to display information in response to actuation of a selected actuator; said integrated circuit being further programmed to display, to increment, to decrement, and to store displayed information in memory in response to actuation of a selected actuator, to perform calculations thereon and to display said information and results of said calculations on said display; said integrated circuit being further programmed to provide vibrations produced by said vibrator alarm device in response to information stored in memory, wherein said improvement comprises:

a multi-mode electronic timepiece especially adapted to assist a user to take a multiple question timed examination, comprising:

setting means responsive to actuation of selected actuators to display and store in said, memory 1) a selected examination time period, 2) a selected number of examination questions, and 3) a selected number of alert points;

computing means computing 1) an average time interval between questions and 2) at least one time interval for establishing at least one alert point before the end of said examination time period;

timing means responsive to actuation of a selected actuator at the commencement of the examination and commencing to count down the examination time period, and to count up the number of examination questions;

display means responsive to said timing means adapted to display time remaining in the examination and the question number corresponding to the time remaining; and alerting means responsive to said timing means actuating said vibrator alarm device at each occurrence of a said alert point;

the computing means being programmed to calculate the time remaining for each displayed question number, the time remaining for said displayed question number being selectively displayed responsive to actuation of a selected actuator.

4. The improvement according to claim 3, wherein said at least one tune interval is pre-selected to establish said at least one alert point as a final alert point just before the end of the examination time period.

5. The improvement according to claim 3, wherein said computing means calculates the average time interval between alert points, and wherein the timing means counts up the number of alert points.

6. Improvement in a multi-mode electronic timepiece, said timepiece having an electrooptic display, a memory, a vibrator alarm device, a plurality of manually actuated actuators and a programmable integrated circuit programmed to keep time and to provide a plurality of timepiece operating modes including a test timer mode, said integrated circuit being further programmed to permit an operator to switch between modes in response to actuation of a selected actuator; said integrated circuit being further programmed to display information in response to actuation of a selected actuator; said integrated circuit being further programmed to display, to increment, to decrement, and to store displayed information in memory in response to actuation of a selected actuator, to perform calculations thereon and to display said information and results of said calculations on said display; said integrated circuit being further programmed to provide vibrations produced by said vibrator alarm device in response to information stored in memory, wherein said improvement comprises:

a multi-mode electronic timepiece especially adapted to assist a user to take a multiple question timed examination, comprising:

setting means responsive to actuation of selected actuators to display and store in said memory 1) a selected examination time period, 2) a selected number of examination questions, and 3) a selected number of alert points;

computing means computing 1) an average time interval between questions and 2) an average time interval between alert points;

timing means responsive to actuation of a selected actuator at the commencement of the examination commencing to count down the examination time period, to count up the number of examination questions, and to count up the number of alert points;

display means responsive to said timing means adapted to display time remaining in the examination and to display a question number corresponding to the time remaining, and alerting means responsive to said timing means actuating said vibrator alarm device at each occurrence of a said alert point;

the computing means being programmed to calculate the time remaining for each displayed question number, the time remaining for said displayed question number being selectively displayed responsive to actuation of a selected actuator.

7. The improvement according to claim 6, wherein said alerting means causes said display means to display a pre-selected message on the electrooptic display at pre-selected alert points after actuating said vibrator alarm device.

8. The improvement according to claim 6, wherein a final alert point is calculated by the computing means to occur at a pie-selected time interval before the end of the examination time interval and wherein said timing means is adapted to actuate the vibrator alarm device at the final alert point.

9. The improvement according to claim 8, wherein the display means displays a final preselected message at said final alert point.

* * * * *